US005230377A

United States Patent [19]

Berman

[11] Patent Number: 5,230,377

[45] Date of Patent: Jul. 27, 1993

[54] BORDER PIECE FOR WALL FABRIC

[75] Inventor: Joel C. Berman, Hewlett, N.Y.

[73] Assignee: Joel Berman Associates, Inc., Hewlett, N.Y.

[21] Appl. No.: 759,577

[22] Filed: Sep. 13, 1991

[51] Int. Cl.[5] ..... A47H 23/00

[52] U.S. Cl. ..... 160/327; 52/222

[58] Field of Search ..... 160/327, 328, 371, 380, 160/378, 399, 402; 52/222, 273; 24/543, 487, 559

[56] References Cited

U.S. PATENT DOCUMENTS 4,625,490 12/1986 Baslow ..... 160/327 X

*Primary Examiner*—Blair M. Johnson

*Attorney, Agent, or Firm*—Amster, Rothstein & Ebenstein

[57] ABSTRACT

An extruded border piece for mounting a fabric sheet in parallel relationship with a plane surface, the border piece including a body portion, a locking portion and a hinge portion connecting the body portion and the locking portion. The locking portion is movable from an open position to a closed position in which the fabric sheet is trapped between the locking and body portions. The body portion may have a surface to which the fabric sheet can be temporarily securable in desired pre-tensioned condition by basting tracks.

19 Claims, 3 Drawing Sheets

BORDER PIECE FOR WALL FABRIC

BACKGROUND OF THE INVENTION

This invention relates to border pieces for wall fabric, and more particularly to a border piece for mounting a fabric sheet parallel to a plane surface, and still more particularly to such a border piece comprising an extruded member including body and locking portions and a hinge portion joining the body and locking portions.

Traditionally, upholstered walls were fabricated by stapling fabric to a wood frame secured to the wall. The fabric was stretched and temporarily tacked, basted to the frame in the same way as classic furniture upholstery to assure the stretching out—tensioning of the fabric, thus eliminating the natural mechanical extensibility of the fabric as well as exposing the fabric to the atmospheric conditions of the area to assure that the fabric will not appear to ripple or sag due to variances in temperature and humidity which will affect the dimensional stability of most fabrics and blends of yarn types used.

The basting and stretching process, wherein the fabric is stretched, basted and restretched until the fabric achieves the appropriate tension, assures that the stretched fabric will withstand the normal expansion and contraction which occur due to changes in temperature and humidity.

Thus, although the fabric may be more or less tight from day to day, due to variances in atmospheric conditions, the fabric wall will still have a substantial degree of a tautness created by this stretching and restretching process so that the wall of fabric will appear flat, smooth and taut, and not appear soft, ripple or sag. Further, the upholstery process of stretching, basting, and restretching permits the upholsterer to pull the warp and weft of the fabric into a square and plumb condition.

The prior art has provided means of mounting fabric without an exposed fastening means; however, no provision was made for appropriate tensioning, retensioning and subsequent mounting of the fabric. A glue surface, as used in the prior art, is an appropriate material to mount and remount and properly tension the fabric. However, due to the substantial amount of fabric dust and foreign matter contained in the fibers of most fabrics, a glue surface is not an appropriate basting means. Furthermore, the ability of a tactile glue surface is substantially compromised and reduced each time a fabric is adhered, removed and readhered to the same glue strip.

Fabric is woven square; however, finishing and uneven tensions within the cloth cause the warp and weft to be askew when the cloth is relaxed, i.e., unrolled. A requirement of the upholstery process is to pull these wayward yarns into their appropriate alignment To do this, it is necessary to put substantial tension on the fabric both in warp and weft to assure the appropriate alignment of the yarns. Thus an additional problem to be overcome in the design of a border piece is the ability to properly tension and secure fabrics of varying thicknesses.

An additional problem is accessibility, i.e., easy removal of the fabric for cleaning, service to the wall behind, access to the wall behind to install a thermostat, electrical outlet, picture blocking or the like and easy replacement thereof.

Acordingly, it is an object of this invention to provide an effective, low-cost fabric mounting system, which is contemporary in design and is concealed in use, avoiding the need for trimming, braids, or other traditional means to hide the mounting system.

Another object is to provide such a system incorporating means for concealed fastening and mounting of the fabric to a frame.

A further object is to provide such a system offering the ability to stretch, baste and restretch the fabric until the appropriate tension is achieved to overcome the natural mechanical extensibility of the fabric.

It is also an object of this invention to provide such a system with sufficient tension to avoid visual rippling or sagging of the fabric due to variances in the atmospheric conditions which can cause the fabric to expand and contract depending on the yarn content.

It is another object is to provide such a system enabling squaring of the fabric under tension in order to assure that the warp and weft are square, plumb and level with the adjacent horizontal surfaces, and plumb with the adjacent vertical surfaces.

It is a further object is to provide such a system possessing a number of advantages over the known prior art, in terms of being cheaper to manufacture, simpler to use, and better and more reliable as to its fabric-holding properties.

SUMMARY OF THE INVENTION

It has now been found that the above and related objects of the present invention are obtained in a border piece usable to mount a fabric sheet parallel to a plane surface, particularly a wall surface. The border piece comprises an extruded member having a body and locking portions of plastic, metal or other material and a coextruded or mechanical hinge portion joining the body and locking portions together at one end thereof. The body portion includes a base providing a front end of the body portion, and first and second ribs extend from one side of the base, the first rib being adjacent the front end. The locking portion includes a cover, and the hinge portion is integrally joined to the cover and to the body portion, with the cover overlying the base. When the hinge portion is unstressed, the cover portion makes a normal predetermined angle with the base. The cover has first and second flanges and is pivotally movable, against bias developed in the hinge portion, to a closed position in which confronting sides of the first flange and the first rib overlap each other with the first rib between the first flange and the hinge portion and the confronting sides of the second flange and the second rib overlap each other. The first rib and the first flange have barbs that interengage each other in the closed position, wherein the barbs of the first rib and the first flange together provide means for clamping the fabric sheet therebetween.

In one preferred embodiment, the second rib and the second flange also have barbs, and the barbs are in positive and direction interengagement to lock the locking portion in the closed position. In another preferred embodiment, the second rib has an enlarged ball-like head and the second flange has a socket-like configuration, open at one end to receive therein the ball-like head and maintain it therein against accidental displacement. The engagement of the two barbs or the engagement of the ball and socket holds the hinge cover in place to withstand tension on the member due to fabric stretching.

Before it is moved to the closed position, the cover is pivotable in the opposite direction, against bias developed in the spring portion, to increase the angle between the cover and the base to an angle greater than the normal predetermined angle to provide space to permit staples to be driven through the base to mount the border piece on the plane surface and to create additional tension in the fabric by shortening the distance between a web of the border piece and the free edge of the cover. When the cover is closed, the fabric is additionally tensioned.

The invention incorporates into a single unitary, integral, one-piece border piece a fabric fastening, tightening, tension and mounting means keeping the best qualities of classic upholstery and incorporating the contemporary design criteria of concealed fastening without an applied trim, braid, or other fabric mounting/concealing means. More particularly, the invention provides a basting surface to properly tension the fabric mechanically without having to use a glue strip, and the glue strip surfaces are provided only to lock "the tail" of the fabric which is to be crimped into the border piece while basting tacks maintain the tension on the fabric. Thus, the fabric is able to be crimped into the locking device without extra tension on the fabric tail. The fabric tension is not put onto the mounting joint until the basting tacks are removed. Then there is a combination of a glue strip used once, plus the mechanical crimping or tacking of the fabric, to securely hold the fabric under tension.

BRIEF DESCRIPTION OF THE DRAWING

The above brief description, as well as further objects and features of the present invention, will be more fully understood by reference to the following detailed description of the presently preferred, albeit illustrative embodiments of the present invention when taken in conjunction with the accompanying drawing wherein.

DETAILED DESCRIPTION OF THE PREFERRED EMBODIMENTS

Figure 1:
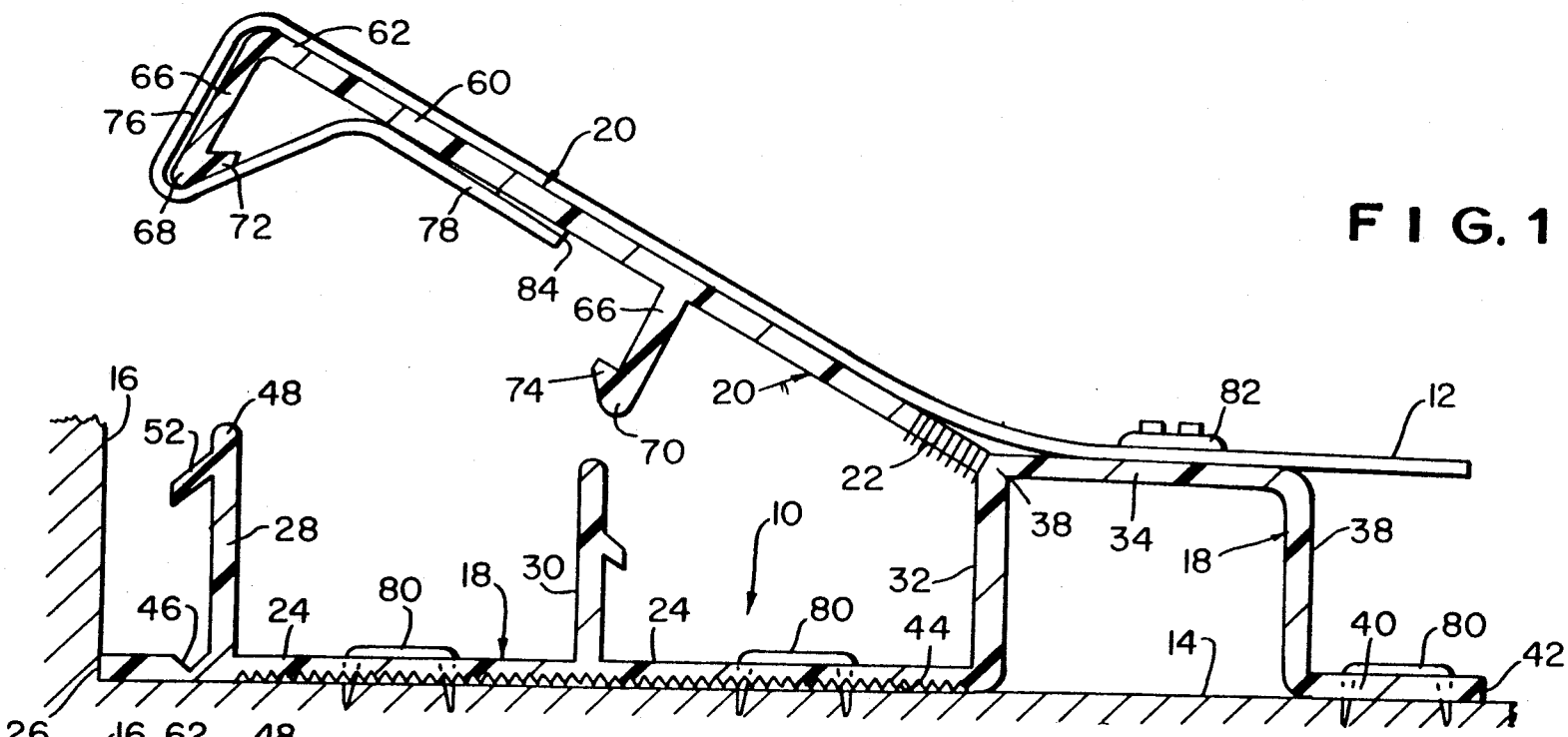
FIG. 1 is a transverse sectional or end view of an extruded border piece according to a first preferred embodiment of the invention, the border piece being shown in its open, as extruded position, attached to a wall adjacent a ceiling and with a fabric sheet preliminarily attached to the border piece.

Referring now to the drawing, FIG. 1 shows a border piece, indicated generally at 10, that is a first preferred embodiment of the invention. The border piece 10 is adapted to mount a fabric sheet 12 in generally parallel relationship with respect to a first plane surface (namely, a wall surface 14) at the border thereof, adjacent the juncture between wall surface 14 and a second plane surface (illustrated as a ceiling surface 16) overhanging and perpendicular to wall surface 14. It will be understood that the second plane surface could be another wall surface or an upwardly facing surface of a baseboard or floor (not shown).

Border piece 10 comprises an extruded member that includes a body portion 18 and a locking portion 20, both of suitable relatively rigid plastic material, such as polyvinyl chloride (PVC), and of substantially the same uniform wall thickness. Body portion 18 and locking portion 20 are integrally or otherwise joined by a coextruded hinge portion 22 that is formed of a blend of a plastic material, such as PVC, and an elastomer for flexibility. Hinge portion 22 is relatively resilient by virtue of the fact that it is coextruded. The coextrusion process is known per se and is also called dual durometer extrusion.

Body portion 18 has a flat base 24 providing body portion 18 with a front end 26. First and second ribs 28 and 30 and a wall 32 extend from the same side of base 24 and are generally parallel to each other and generally perpendicular to base 24. Rib 28 is adjacent front end 26, wall 32 is remote from rib 28, and rib 30 is between rib 28 and wall 32. Extending away from the edge of wall 32 and remote from base 24, body portion 18 has a web 34 integral with wall 32 at a juncture 36 and extending generally parallel to (but spaced from) the plane of base 24. A leg 38 depends from the edge of web 34 remote from the juncture 36 and extends to the plane of base 24, and a foot 40 extends from the edge of leg 38 remote from web 34, parallel to the plane of base 24 and in the direction away from walls 32, 38 to a back end 42 of body portion 24. Foot 40 is essentially coplanar with base 24.

Web 34 preferably lies in a plane that makes a small acute angle with the plane of base 24. The acute angle may be on the order of 1°49', the angle being oriented such that the apex thereof is closer to front end 26 than to back end 42. Web 34 furnishes border piece 10 with a stop ground or basting surface.

The side of base 24 from which ribs 28, 30 and 32 extend has a V-notch 46 at a location between front end 26 and rib 28. The V-notch 46 extends more than half way through base 24, and the portion of base 24 between end 26 and notch 46 can be broken off and discarded if desired.

Ribs 28 and 30 have free upper edges 48 and 50, respectively, free edge 48 being further from base 24 than free edge 50. Rib 28 has, along its side facing away from wall 32, a locking barb 54 projecting angularly toward base 24; and rib 30 has, along its side facing wall 32, a locking barb 54 projecting angularly toward base 24.

Locking portion 20 is shown in its open or as extruded position relative to body portion 18 in FIG. 1. Locking portion 20 provides the extruded member with a flat cover 60 that is part of locking portion 20. Cover 60 is joined to body portion 18 by a coextruded hinge portion 22. In the open, as extruded position of border piece 10 (FIG. 1), the plane of cover 60 makes an acute angle with base 24 that is shown as about 30°. Cover 60 provides locking portion 20 with a front end 62. Locking portion 20 also has first and second flanges 64 and 66, respectively, that depend from the side of cover 60 facing base 24. Flange 64, which depends from front end 62, makes an acute angle of about 85° with cover 60; and flange 66, which is located between flange 64 and hinge portion 22, is substantially perpendicular to cover 60.

Flanges 64 and 66 have free inner edges 68 and 70, respectively, generally facing base portion 24 when the locking portion 20 is in the closed position. Flange 64 has, along its side facing flange 66, a locking barb 72 projecting from free edge 68 angularly toward cover 60; and flange 66 has, along its side facing flange 64, a locking barb 74 projecting from free edge 70 angularly toward cover 60.

Border piece 10 can be moved from its open, as extruded position (FIG. 1) to its closed, final or locking position (FIG. 2), by squeezing cover 60 facing base 24, between flanges 64 and 66.

Figure 2:
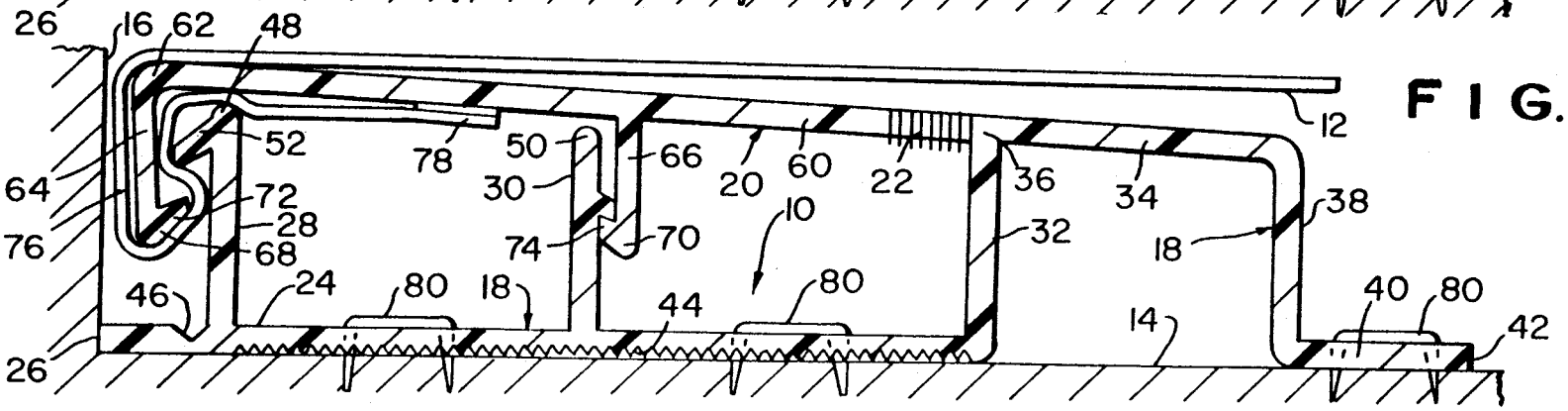
FIG. 2 is a view similar to FIG. 1 but showing the border piece of FIG. 1 in its closed, final position, and the fabric sheet in its final, installed condition.

It is also noted that, in addition to accommodating resilient flexure of cover 60 from the position shown in FIG. 1 to the position shown in FIG. 2, hinge portion 22 also permits cover 60 to be resiliently flexed within limits from the position shown in FIG. 2 in the opposite direction.

The manner of use of border piece 10 to mount fabric sheet 12 as aforesaid will now be described. Border piece 10 is placed with base 24 against wall surface 14 and front end 26 abutting ceiling surface 16. Cover 60 is then resiliently flexed about hinge portion 22 from the position shown in FIG. 1 away from base 24 to increase the angle between cover 60 and base 24. With cover 60 thus opened up, a plurality of staples 80 are driven through base 24, between ribs 28 and 30 and between ribs 30 and 32 and through foot 40, and into wall surface 14. If desired, the portion of base 24 between V-groove 46 and front end 26 may now be removed and discarded. Serrations 44 and glue assist in holding border piece 10 in the illustrated and described position relative to wall and ceiling (or floor) surfaces 14 and 16 until staples 80 are driven.

Next, fabric sheet 12 is pulled taut at web 34 and is temporarily secured to web 34 by a plurality of basting tacks 82, one of which is shown in FIG. 1. Fabric sheet 12 has a free edge 84, and the portion of fabric sheet 12 between tacks 82 and free edge 84 is pulled taut and then secured to tape 76 and to tape 78 with the portion of fabric sheet 12 between tape 76 and tape 78 passing over free end 68 of rib 64 and over barb 72. The tacking of sheet 12 to web 34 positions the sheet 12 on a permanently affixed member, permitting the free end 84 of the fabric to be engaged on the glue or adhesive surfaces 76, 78 and then crimped in place before basting tacks 82 are removed, thus transferring tension from basting tacks 82 onto the border piece 10.

The mounting of fabric sheet 12 is completed by thereupon squeezing cover 60 toward base 24, as described above, until barbs 72 and 74 lockingly interengage barbs 52 and 54, respectively, as already described. Tension on locking portion 20 causes the fabric to be crimped between barbs 52 and 72. Rib 30 and flange 66, and their barbs 54 and 74, are so arranged and dimensioned that barbs 54 and 74 interengage so as to make cover 60 a planar extension of web 34, i.e., with cover 60 making an acute angle of only about 1°49′ with base 24. The bias in hinge portion 22 combined with the tension in fabric piece 12 tends to maintain this relationship. Then tacks 82 are removed.

It will be noted that the interengagement of barbs 52 and 72 is somewhat loose, permitting a portion of fabric sheet 12 to pass therebetween, whereas the interengagement of barbs 54 and 74 is tight, positive and direct (without any portion of fabric sheet 12 therebetween). Conceivably, without barbs 54 and 74, the substantial tension in fabric sheet 12, combined with the bias in hinge portion 22, could cause cover 60 to open, with disastrous results.

It should also be noted that the elastomer in coextruded hinge portion 22 may tend to cause hinge portion 22 to elongate, which elongation, if permitted to take place, might give rise to misalignment of the fabric clamping means which is provided by barbs 52 and 72 and a non-uniform fit of fabric sheet 12. The potential elongation of hinge portion 22 is avoided by having flange 66 dimensioned and placed so that in the final or closed position flange 66 is between rib 30 and rib 32, maintaining the dimensional relationship between rib 28 and flange 64.

To give some idea of size, the integral, unitary, one-piece extruded border piece 10 may be about 3 inches (7.62 cm) long from front end 26 to back end 42.

Figure 3:
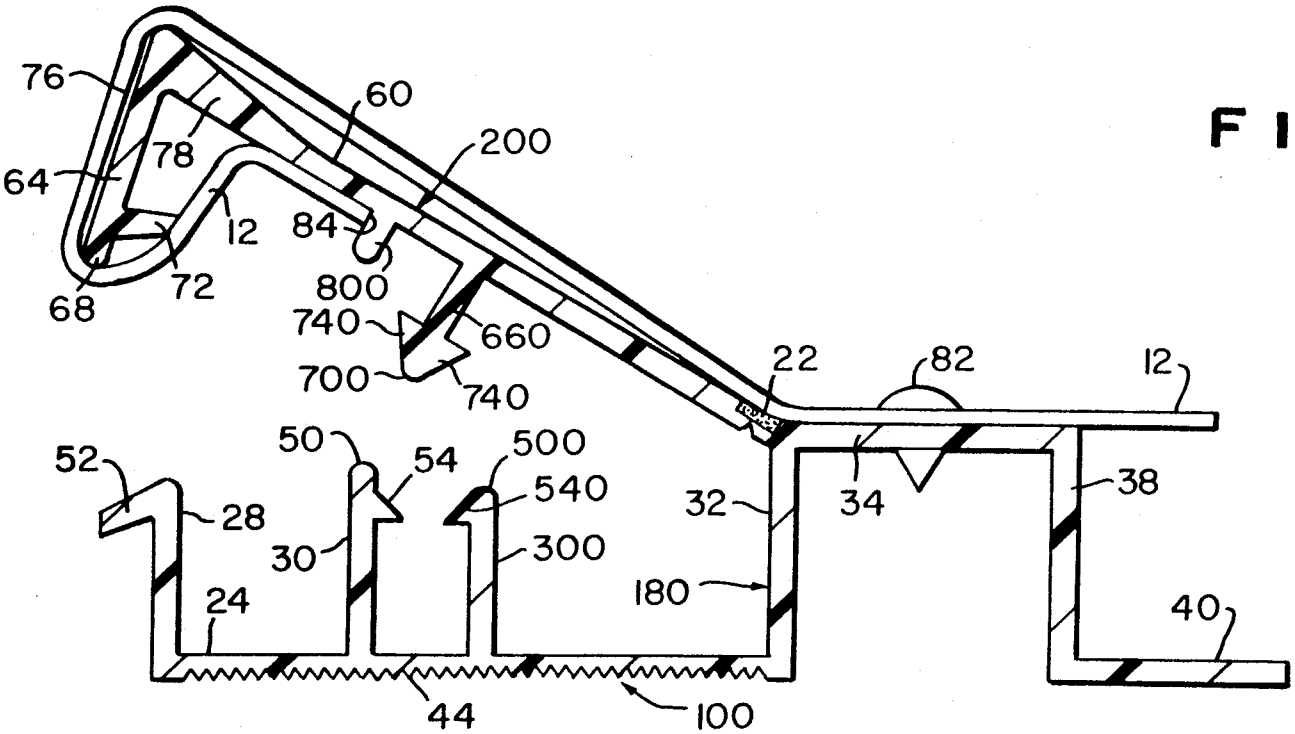
FIG. 3 is a transverse sectional or end view of an extruded border piece according to a second preferred embodiment of the invention, the border piece being shown in its open, as extruded position with a fabric sheet preliminarily attached to the border piece.
Figure 4:
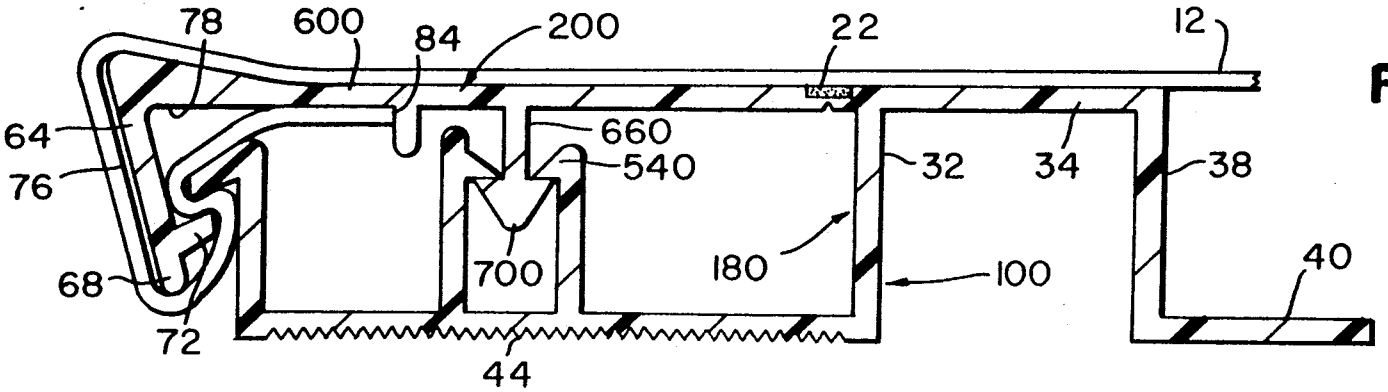
FIG. 4 is a view similar to FIG. 3 but showing the border piece in its closed, final position, and the fabric sheet in its final, installed condition.

FIGS. 3 and 4 show an extruded border piece 100 which is a second preferred embodiment of the invention. The manner in which border piece 100 differs from border piece 10 is believed to be largely self-evident. In general, border piece 100 inherently enables better and more positive control of fabric sheet 12 than is obtained with border piece 10. Elements of border piece 100 that are the same as those of border piece 10 have been given the same reference numerals, whereas elements that differ have been given different three digit reference numerals.

Thus, border piece 100 includes a body portion 180 and a locking portion 200, integrally or otherwise joined together by a hinge portion 22. Body portion 180 differs from body portion 18 of border piece 10 by virtue of having a third rib 300 projecting upwardly from flat base 24, parallel to second rib 30 and between second rib 30 and wall 32. Rib 300 has an inner free end 500 with a barb 540 confronting and a mirror image of barb 54.

Locking portion 200 includes a cover 600 having a flange 660 projecting from the inner surface of cover 600 and having a free end 700 with mirror image barbs 740, projecting forward and backward from respective sides thereof. When locking portion 200 and base 24 are closed, the barbs 52, 72 interengage, as previously described, and the barbs 740 of the free end of flange 60 interengage with the barbs 54, 540 of ribs 30, 300 of base 24. Because border piece 100 provides for locking of flange 660 on both sides thereof by ribs 30, 300 (rather than merely on one side thereof as in border piece 10), border piece 100 provides a more secure lock or interengagement between the body portion and the locking portion as well as improved dimensional stability.

Locking portion 200 also is provided with an additional flange 800 parallel to flange 660 and spaced forwardly therefrom a distance sufficient to receive rib 30 between flange 660 and flange 800. It is significant that flange 800 serves as a stop surface for free end 84 of fabric piece 12, thus significantly avoiding the otherwise real possibility that fabric piece 12 might find its way as far as flange 660, thereby fouling interengagement of flange 660 with ribs 30 and 300. Thus, border piece 100 achieves better control of fabric sheet 12 than does border piece 10.

With either border piece 10 or border piece 100, the interaction of the tension on the border piece profile, once basting tacks 82 are removed, and the interaction between the support barbs and the cooperation of the support barbs to hold all of the components together in proper fashion cannot be overemphasized.

Figure 5:
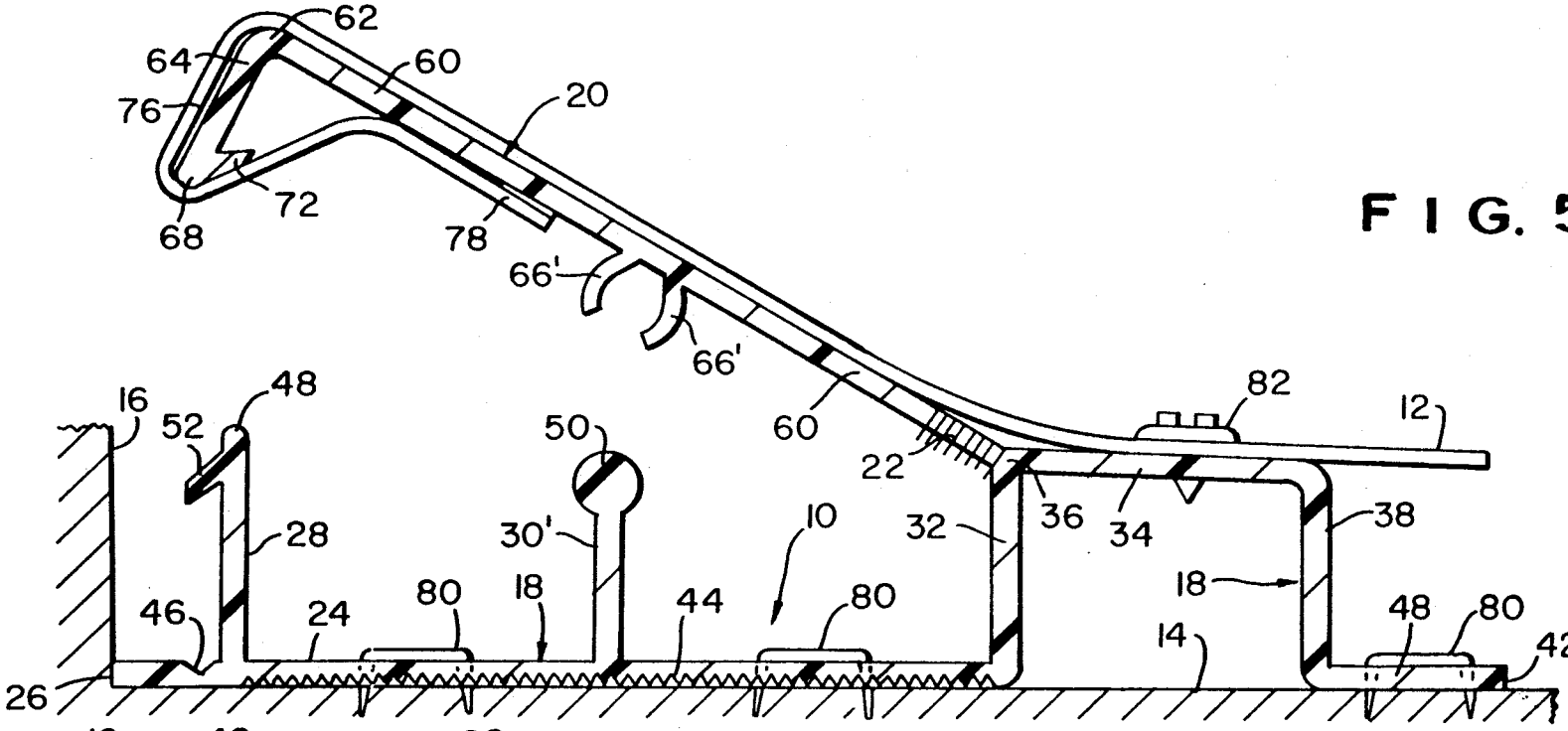
FIG. 5 is a transverse sectional or end view of an extruded border piece according to a third preferred embodiment of the invention, the border piece being shown in its open, as extruded position with a fabric sheet preliminarily attached to the border piece.
Figure 6:
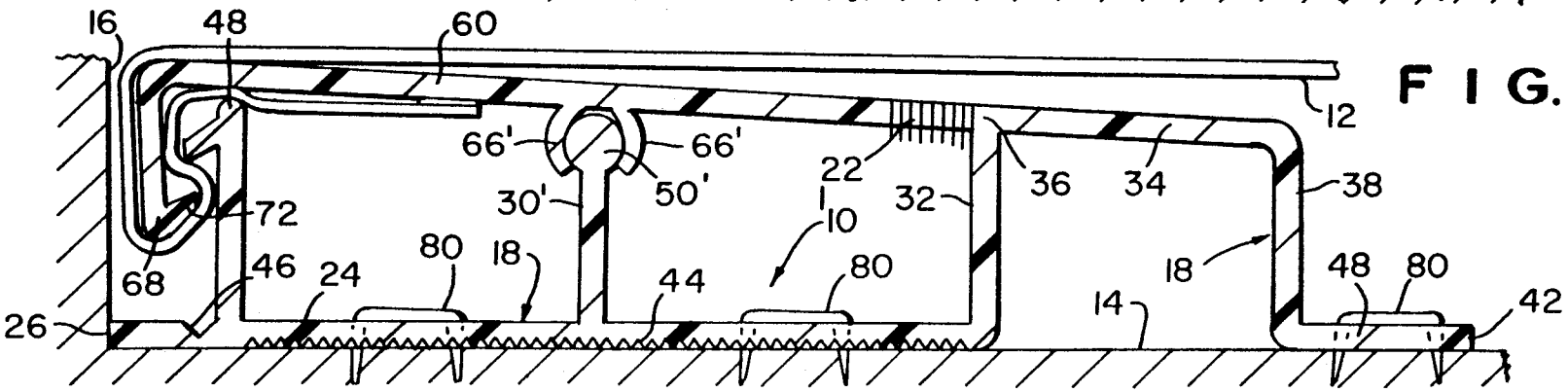
FIG. 6 is a view similar to FIG. 5 but showing the border piece in its closed, final position, and the fabric sheet in its final, installed condition.

FIGS. 5 and 6 show an extruded border piece 10' which is a third preferred embodiment of the invention, identical to the embodiment 10 of FIGS. 1 and 2 except that the rib 30' on the base portion 24 has (instead of a barb 54) at its free end a single cylindrical element 50' of enlarged diameter similar in cross section to a ball, and the flange 66' on the locking portion 20 has (instead of a barb 74) two arcuately and outwardly bowed flange sections defining in cross section a socket 70' open at the free end thereof (as illustrated in FIG. 5) and adapted to receive therewithin the ball 50' of rib 30' (as illustrated in FIG. 6) and maintain it there against accidental displacement. Clearly both the ball 50' and socket 70' extend substantially the length of the border piece 10'. The ball-and-socket locking mechanism 50', 70' of the third embodiment 10' provides a direct and positive interengagement of the locking portion and body portion, similar to the interengaging of the barbs of the other embodiments 10, 100, but affords an enhanced engagement relative thereto.

To summarize, the present invention provides an effective, low cost fabric mounting system which is contemporary in design and is concealed in use, avoiding the need for trimming, braids or other traditional means to hide the mounting system. The system incorporates means for concealed and fastening amounting of the fabric to a frame and offers the ability to stretch, baste and restretch the fabric until the appropriate tension is achieved overcome the natural mechanical extensibility of the fabric, thereby to avoid visual rippling or sagging of the fabric due to variances in the atmospheric conditions (which can cause the fabric to expand and contract depending upon the yarn content). Further, the system enables squaring of the fabric under tension in order to assure that the warp and weft are square, plumb and level with the adjacent horizontal surfaces, and plumb with the vertical surfaces. Additionally, the system is cheaper to manufacture, simpler to use, and better and more reliable as to its fabric-holding properties than conventional counterparts.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing disclosure.

What is claimed is:

1. A border piece for mounting a fabric sheet in parallel relationship with a plane surface, said border piece comprising an extruded member including a body portion providing said border piece with a base adapted to engage the plane surface, a locking portion, and a hinge portion connecting said body portion and said locking portion, said locking portion providing said border piece with a cover that is pivotally movable from an open position to a closed position in which the fabric sheet is trapped between said body portion and said locking portion;

said locking and body portions having confronting movable and stationary surfaces, respectively, and said locking portion having first and second flanges projecting from said movable surface with said second flange between said first flange and said hinge portion, said body portion having first, second and third ribs projecting from said stationary surface, said first flange and said first rib being positioned to overlap each other in said closed position, and said second flange and said second rib being positioned to overlap each other in said closed position, said first flange and said first rib having surfaces that overlap and functionally interengage each other in said closed position, and said second flange and said second rib having surfaces that overlap and interengage each other in said closed position, said first rib and said first flange providing means for clamping the fabric sheet therebetween, and said second rib and second flange providing means for positive and direct interengagement to lock said locking portion in said closed position;

said first and second ribs being between said first and second flanges, and each of said second and third ribs having a barb at its upper end facing said barb on the other of said second and third ribs, and said second flange having two barbs thereon for locking interengagement with said barbs on said second and third ribs.

2. A border piece according to claim 1 wherein said locking and body portions have confronting surfaces which, when said locking portion is moved to its closed position, cooperate with each other to hold said locking portion in said closed position and crimp the fabric piece to hold the same.

3. A border piece according to claim 1 wherein said locking portion and said body portion are of relatively rigid plastic material and said hinge portion is coextruded of a blend of said plastic material and an elastomer.

4. A border piece according to claim 1 further comprising an additional flange projecting from said movable surface at a location between said first and second flanges, said additional flange serving as a stop to prevent the end of the fabric sheet from fouling the positive and direct interengagement of said locking and body portions.

5. A border piece according to claim 1 wherein, when said cover is moved to said closed position, said second flange enters a gap between said second and third ribs, and said additional flange and said second flange straddle said second rib with said additional flange not engaging said second rib.

6. A border piece according to claim 1 wherein said member is configured and dimensioned such that, prior to moving said cover to said closed position, staples may be driven through said base to attach said border piece to the plane surface.

7. A border piece according to claim 1 where said body portion further includes a wall having a lower edge joining said base and an upper edge joining said hinge portion.

8. A border piece according to claim 1 wherein the side of said base from which said ribs project has, at a location between said first rib and a free end of said end, a V-notch so that the portion of said base between said V-notch and said free end can be removed and discarded.

9. A border piece according to claim 1 wherein the side of said base remote from said locking portion has serrations.

10. A border piece according to claim 1 further comprising tape with adhesive on both sides on the side of said first flange facing away from said second flange and tape with adhesive on both sides on the side of said cover facing said base, between said first and second flanges.

11. A border piece according to claim 1 wherein said plastic material is polyvinyl chloride.

12. A border piece according to claim 1 wherein said cover in said open position makes a normal acute angle of about 30° with said base.

13. A border piece according to claim 1 wherein said second rib defines an enlarged spherical head at its free end and said second flange defines a socket-like recess adapted to receive said enlarged spherical head therewithin and maintain said enlarged head therewithin against accidental displacement.

14. A border piece for mounting a fabric sheet in parallel relationship with a plane surface, said border piece comprising an extruded member including a body portion providing said border piece with a base adapted to engage the plane surface, a locking portion, and a hinge portion connecting said body portion and said locking position, said locking portion providing said border piece with a cover that is pivotally movable from an open position to a closed position in which the fabric sheet is trapped between said body portion and said locking portion;

said locking and body portions having confronting movable and stationary surfaces, respectively, and said locking portion having first and second flanges projecting from said movable surface with said second flange between said first flange and said hinge portion, said body portion having first, second and third ribs projecting from said stationary surface, said first flange and said first rib being positioned to overlap each other in said closed position, and said second flange and said second rib being positioned to overlap each other in said closed position, said first flange and said first rib having surfaces that overlap and functionally interengage each other in said closed position, and said second flange and said second rib having surfaces that overlap and interengage each other in said closed position, said first rib and said first flange providing means for clamping the fabric sheet therebetween, and said second rib and second flange providing means for positive and direct interengagement to lock said locking portion in said closed position;

said body portion further including a wall having a lower edge joining said base, an upper edge joining said hinge portion, and a web that provides a surface to which the fabric sheet is temporarily securable, said web making an integral juncture with said wall at its said upper edge and extending therefrom in the direction away from said front end of said body portion, a leg depending from the edge of said web remote from said juncture and a foot extending from the edge of said leg remote from said web in the direction away from said wall to a back end of said body portion, said foot being essentially complanar with said base.

15. A border piece according to claim 14 wherein said web furnishes said border piece with a basting surface.

16. A border piece according to claim 14 wherein said web makes a small acute angle with the plane of said base.

17. A border piece according to claim 16 wherein said small acute angle is about 1°49'.

18. A border piece according to claim 14 wherein, when said locking portion is in said closed position, said cover is essentially a continuation of said web, making said small acute angle with said base.

19. A border piece according to claim 14 wherein, when said cover is in said closed position, the fabric sheet is trapped and tensioned between said body portion and said locking portion and blocking substantially the entirety of said border piece from normal viewing.

* * * * *